US006421422B1

(12) United States Patent
Lifshin et al.

(10) Patent No.: US 6,421,422 B1
(45) Date of Patent: Jul. 16, 2002

(54) APPARATUS AND METHOD FOR INCREASING X-RAY TUBE POWER PER TARGET THERMAL LOAD

(75) Inventors: Eric Lifshin, Voorheesville; Amy Linsebigler Smentkowski, Clifton Park; William Guy Morris, Rexford; Lembit Salasoo, Niskayuna; Subhasish Roychoudhury, Albany, all of NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/547,242

(22) Filed: Apr. 11, 2000

Related U.S. Application Data

(60) Provisional application No. 60/150,639, filed on Aug. 25, 1999.

(51) Int. Cl.[7] ..... H01J 35/02
(52) U.S. Cl. ..... 378/121; 378/125; 378/143
(58) Field of Search ..... 378/121, 130, 378/125, 143; 313/40

(56) References Cited

U.S. PATENT DOCUMENTS

| | | | | |
|---|---|---|---|---|
| 3,719,846 A | 3/1973 | Berends et al. | ..... | 378/121 |
| 4,309,637 A | 1/1982 | Fetter | ..... | 378/130 |
| 4,392,235 A | 7/1983 | Houston | ..... | 378/10 |
| 5,029,195 A | 7/1991 | Danos | ..... | 378/121 |
| 5,128,977 A | 7/1992 | Danos | ..... | 378/121 |
| 5,206,895 A | 4/1993 | Danos | ..... | 378/121 |
| 5,751,784 A | 5/1998 | Enck | | |
| 5,828,727 A | 10/1998 | Schild | ..... | 378/140 |

FOREIGN PATENT DOCUMENTS

| | | | |
|---|---|---|---|
| DE | 195 09 006 | 9/1996 | |
| DE | 195 13 289 | 10/1996 | |
| EP | 0 163 321 | 12/1985 | |
| EP | 0 210 076 | 1/1987 | |
| EP | 0 584 871 | 3/1994 | |
| JP | 58-59546 | * 8/1983 | ..... 378/121 |

OTHER PUBLICATIONS

"X–Ray Generating Device," Y. Ichiro, Inventor; Mitsubishi Heavy Ind. LTD, Applicant; Patent Abstracts of Japan, Publication No. 01134842, vol. 013, No. 383, Aug. 24, 1989.

* cited by examiner

*Primary Examiner*—Drew A. Dunn
(74) *Attorney, Agent, or Firm*—Lester R. Hale; Donald S. Ingraham

(57) ABSTRACT

An X-ray tube assembly includes an anode, a cathode, and an X-ray transparent window. The anode includes an X-ray-producing target having a surface. The cathode has an electron-beam axis which intersects the target surface at a focal point and which is oriented at a first angle, with respect to the target surface, wherein the first angle is generally twenty degrees. The window includes a surface having a center point. A line between the focal and center points makes a second angle, with respect to the target surface, wherein the second angle is generally seven degrees. A method for producing X-rays employs these angles.

8 Claims, 3 Drawing Sheets

APPARATUS AND METHOD FOR INCREASING X-RAY TUBE POWER PER TARGET THERMAL LOAD

This application claims priority of a Provisional Application entitled "X-Ray Tube With Enhanced X-Ray Energy Output" by Eric Lifshin et al., Ser. No. 60/150,639 filed Aug. 25, 1999.

BACKGROUND OF THE INVENTION

The present invention relates generally to X-ray tubes, and more particularly to an X-ray tube having a higher ratio of X-ray energy flux to power deposited in the target.

X-ray devices used in the medical field contain an X-ray tube which typically includes a cathode which is heated to emit a beam of electrons, a (typically rotating) anode having a target with a surface facing the cathode, and a surrounding glass and/or metal frame containing an X-ray-transparent window secured by a window mount. Typically, the cathode is oriented such that the electrons strike a focal spot on the target surface at an angle which is generally ninety degrees with respect to the target surface. Some emitted electrons strike the target surface and produce X-rays, and some of the X-rays exit the frame as an X-ray beam through the X-ray-transparent window. Typically, the X-ray window is positioned such that it receives X-rays which leave the target surface at an angle of generally seven degrees with respect to the target surface. Some emitted electrons do not produce X-rays and may be backscattered when they strike the target surface. Many of the backscattered electrons go on to strike and heat the frame including the X-ray-transparent window and the window mount. The frame is also heated from within by other sources such as thermal radiation. The heated frame is typically cooled by a liquid coolant, such as oil or water, located between the frame and a surrounding casing having its own X-ray-transparent window.

Generally less than one percent of the power of the electrons striking the target surface is converted into X-ray power. Increasing the power of the electron beam will increase the X-ray power output of the tube. However, increasing the power of the electron beam leads to unacceptably high thermal loading of the target which ultimately limits the X-ray power output. What is needed is an X-ray tube assembly, and a method for producing X-rays, which increases the ratio of X-ray tube power per target thermal load.

BRIEF SUMMARY OF THE INVENTION

In a first expression of an embodiment of the invention, an X-ray tube assembly includes an X-ray tube anode, an X-ray tube cathode, and an X-ray tube window. The anode includes an X-ray-producing target having a surface. The cathode has an electron-beam axis. The electron-beam axis intersects the target surface at a focal point, and the electron-beam axis is oriented at a first angle with respect to the surface of the target. The first angle is between and including fifteen degrees and sixty degrees. The window includes a surface having a center point, and a line between the focal and center points makes a second angle with respect to the target surface.

In a second expression of an embodiment of the invention, an X-ray tube assembly includes an X-ray tube anode, an X-ray tube cathode, and an X-ray tube window. The anode includes an X-ray-producing target having a surface. The cathode has an electron-beam axis. The electron-beam axis intersects the target surface at a focal point, and the electron-beam axis is oriented at a first angle with respect to the surface of the target. The first angle is between and including fifteen degrees and sixty degrees. The X-ray tube cathode produces electrons which strike the target producing X-rays having energies less than generally two hundred kilovolts. The window includes a surface having a center point, and a line between the focal and center points makes a second angle with respect to the target surface. The second angle is less than the first angle. The electron-beam axis and the center point define a plane which is oriented generally perpendicular to the target surface.

A first method of the invention is for producing X-rays and includes steps a) through c). Step a) includes generating a beam of electrons, wherein the beam has an electron-beam axis. Step b) includes orienting the beam of electrons to strike a focal spot on a surface of an X-ray-producing target to generate X-rays such that the electron-beam axis makes a first angle with respect to the surface of the X-ray target and such that the first angle is between and including fifteen degrees and sixty degrees. Step c) includes utilizing those X-rays which make a second angle with respect to the surface of the target.

A second method of the invention is for producing X-rays and includes steps a) through c). Step a) includes generating a beam of electrons, wherein the beam has an electron-beam axis. Step b) includes orienting the beam of electrons to strike a focal spot on a surface of an X-ray-producing target to generate X-rays having energies less than generally two hundred kilovolts such that the electron-beam axis makes a first angle with respect to the surface of the X-ray target and such that the first angle is between and including fifteen degrees and sixty degrees. Step c) includes utilizing those X-rays which make a second angle with respect to the surface of the target, wherein the second angle is less than the first angle, and which, together with the electron-beam axis, define a plane oriented generally perpendicular to the surface of the target.

Several benefits and advantages are derived from choosing the first angle (which typically is called the electron-beam incident angle and referred to as "alpha") and the second angle (which typically is called the X-ray emission angle and referred to as "beta") in accordance with the invention. For example, computer simulations benchmarked by experimental data show an X-ray energy flux enhancement of generally 1.5 when beta equals seven degrees and when alpha equals fifteen to twenty degrees. The enhancement is computed in comparison to the X-ray energy flux of the prior art design wherein beta is seven degrees and alpha is ninety degrees, wherein the deposited power (i.e., the thermal load measured by temperature) and focal-spot temperature in the target is the same in the inventive and prior-art designs, and wherein the X-ray spectra of the inventive design is filtered to obtain the same mean photon (i.e., X-ray) energy as that of the prior-art design, for proper comparison, as can be appreciated by those skilled in the art. An enhancement of 1.5 means a fifty percent increase in X-ray power output for the same thermal load and focal-spot temperature in the target for the inventive design compared to the prior-art design. It also means the X-ray tube of the inventive design can be operated at the same X-ray power output, but at a lower temperature (to increase tube life) compared to the X-ray tube of the prior-art design.

DETAILED DESCRIPTION OF THE INVENTION

Figure 1:
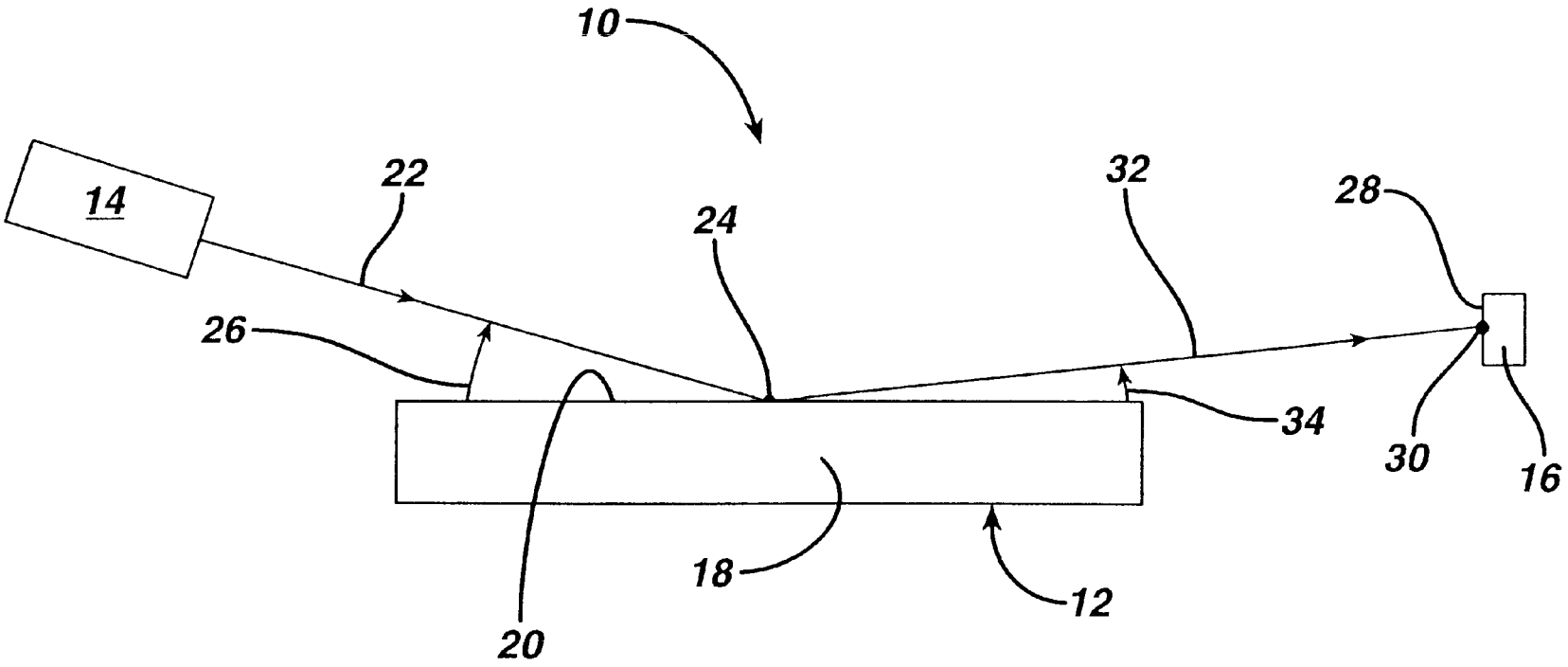
FIG. 1 is a schematic view of an embodiment of an X-ray tube assembly of the present invention.

Referring now to the drawings, FIG. 1 schematically shows an embodiment of the X-ray tube assembly 10 of the present invention. In a first expression of the embodiment shown in FIG. 1, the X-ray tube assembly 10 includes an X-ray tube anode 12, an X-ray tube cathode 14, and an X-ray tube window 16. The anode 12 includes an X-ray-producing target 18 having a surface 20. The cathode 14 has an electron-beam axis 22. The electron-beam axis 22 intersects the surface 20 of the target 18 at a focal point 24, and the electron-beam axis 22 is oriented at a first angle 26 with respect to the surface 20 of the target 18. The first angle 26 is between and including fifteen degrees and sixty degrees. The window 16 is an X-ray transparent window, as is known to those skilled in the art, and includes a surface 28 having a center point 30. The center point 30 is a geometric center point. For example, when the surface of the window has a shape of a rectangle, the center point is the intersection of the diagonals of the rectangle. A line 32 between the focal and center points 24 and 30 makes a second angle 34 with respect to the surface 20 of the target 18.

In one design, the first angle 26 is between and including fifteen and thirty degrees, and the second angle 34 is between and including five degrees and fifteen degrees. In another design, the first angle 26 is generally twenty degrees, and the second angle is generally seven degrees. For purposes of describing the invention, the terminology "generally×degrees" means×degrees plus or minus two degrees. In one construction, the electron-beam axis 22 and the center point 30 define a plane (i.e., the plane of the paper of FIG. 1) which is oriented generally perpendicular to the surface 20 of the target 18. For purposes of describing the invention, the terminology "generally perpendicular" means perpendicular plus or minus two degrees. In one example, the cathode 14 produces electrons (aligned with and centered about the electron-beam axis 22) which strike the target 18 producing X-rays having energies less than generally two hundred kilovolts, wherein some of the X-rays which are aligned with and centered about line 32 pass through the window 16 and are used for various purposes such as medical diagnosis. Typically, X-rays used for medical diagnosis have energies less than generally two hundred kilovolts. For purposes of describing the invention, the terminology "less than generally two hundred kilovolts" means less than two hundred five kilovolts. It is noted that the electron-beam axis 22 is a directional line indicating the direction of travel of those electrons whose trajectories coincide with the electron-beam axis 22. It also is noted that line 32 is a directional line indicating the direction of travel of those X-rays whose trajectories coincide with line 32. In one embodiment, the second angle 34 is less than the first angle 26.

In a second expression of the embodiment shown in FIG. 1, the X-ray tube assembly 10 includes an X-ray tube anode 12, an X-ray tube cathode 14, and an X-ray tube window 16. The anode 12 includes an X-ray-producing target 18 having a surface 20. The cathode 14 has an electron-beam axis 22. The electron-beam axis 22 intersects the surface 20 of the target 18 at a focal point 24, and the electron-beam axis 22 is oriented at a first angle 26 with respect to the surface 20 of the target 18. The first angle 26 is between and including fifteen degrees and sixty degrees. The cathode 14 produces electrons which strike the target 18 producing X-rays having energies less than generally two hundred kilovolts. The window 16 is an X-ray transparent window, as is known to those skilled in the art, and includes a surface 28 having a center point 30. The center point 30 is a geometric center point. A line 32 between the focal and center points 24 and 30 makes a second angle 34 with respect to the surface 20 of the target 18. The second angle 34 is less than the first angle 26. The electron-beam axis 22 and the center point 30 define a plane (i.e., the plane of the paper of FIG. 1) which is oriented generally perpendicular to the surface 20 of the target 18. In one design, the first angle 26 is between and including fifteen and thirty degrees, and the second angle 34 is between and including five degrees and fifteen degrees. In another design, the first angle 26 is generally twenty degrees, and the second angle is generally seven degrees.

A first method of the invention is for producing X-rays and includes steps a) through c). Step a) includes generating a beam of electrons, wherein the beam has an electron-beam axis 22. Step b) includes orienting the beam of electrons to strike a focal spot (having a geometric center called a focal point 24) on a surface 20 of an X-ray-producing target 18 to produce X-rays such that the electron-beam axis 22 makes a first angle 26 with respect to the surface 20 of the target 18 and such that the first angle 26 is between and including fifteen degrees and sixty degrees. Step c) includes utilizing those X-rays which make a second angle 34 with respect to the surface 20 of the target 18.

In one application of the first method of the invention, the first angle 26 is between and including fifteen degrees and thirty degrees, and the second angle 34 is between and including five degrees and fifteen degrees. In another application of the first method, the first angle 26 is generally twenty degrees, and the second angle is generally seven degrees. In one example of the first method of the invention, step c) includes utilizing those X-rays which, together with the electron-beam axis 22, define a plane oriented generally perpendicular to the surface 20 of the target 18. In another example of the first method, step b) producing X-rays having an energy less than generally two hundred kilovolts. In one employment, the second angle 34 is less than the first angle 26

A second method of the invention is for producing X-rays and includes steps a) through c). Step a) includes generating a beam of electrons, wherein the beam has an electron-beam axis 22. Step b) includes orienting the beam of electrons to strike a focal spot (having a geometric center called a focal point 24) on a surface 20 of an X-ray-producing target 18 to produce X-rays having energies less than generally two hundred kilovolts such that the electron-beam axis 22 makes a first angle 26 with respect to the surface 20 of the target 18 and such that the first angle 26 is between and including fifteen degrees and sixty degrees. Step c) includes utilizing those X-rays which make a second angle 34 with respect to the surface 20 of the target 18, wherein the second angle 34 is less than the first angle 26, and which, together with the electron-beam axis 22, define a plane oriented generally perpendicular to the surface 20 of the target 18. In one application of the second method of the invention, the first angle 26 is between and including fifteen degrees and thirty degrees, and the second angle 34 is between and including five degrees and fifteen degrees. In another application of the second method, the first angle 26 is generally twenty degrees, and the second angle is generally seven degrees.

Applicants conducted experiments to obtain data on X-ray energy flux enhancement for different values of the first angle 26 (which typically is called the electron-beam incident angle and referred to as "alpha") and the second angle 34 (which typically is called the X-ray emission angle and-referred to as "beta"). By "enhancement" is meant the X-ray energy flux for different values of the first and second angles were divided by the X-ray energy flux obtained using a prior-art design of a ninety-degree first angle 26 (i.e., alpha equals ninety degrees) and a seven-degree second angle 34 (i.e., beta equals seven degrees), wherein the deposited power (i.e., the thermal load measured by temperature) in the target 18 is the same in the inventive and prior-art designs, and wherein the X-ray spectra of the inventive design is filtered to obtain the same mean photon (i.e., X-ray) energy as that of the prior-art design, for proper comparison, as can be appreciated by those skilled in the art. An enhancement of 1.5 means a fifty percent increase in X-ray power output for the same thermal load on the target 18 for the inventive design compared to the prior-art design. It also means the X-ray tube assembly 10 of the inventive design can be operated at the same X-ray power output, but at a lower temperature (to increase tube life) compared to the X-ray tube assembly of the prior-art design.

Figure 2:
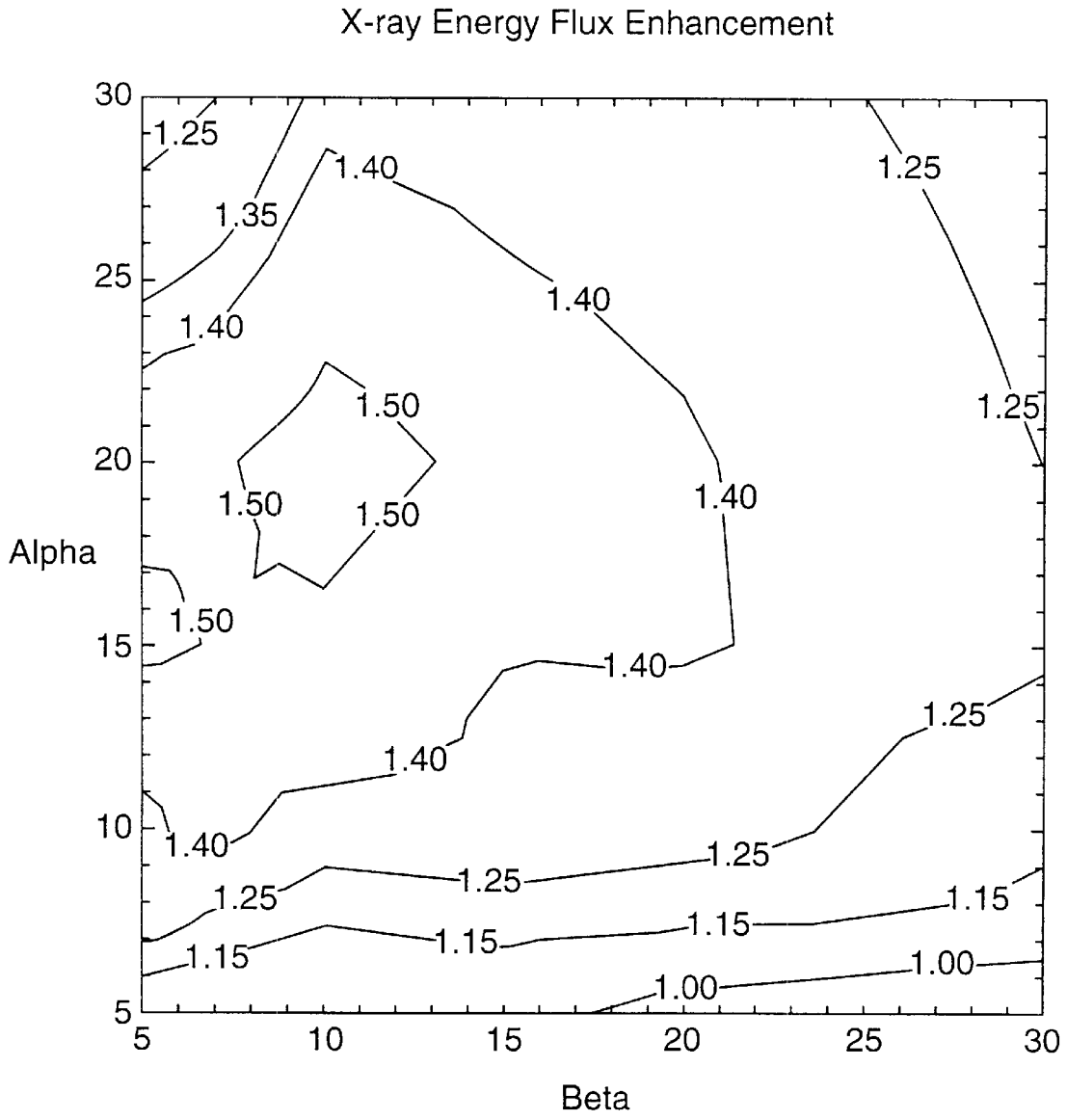
FIG. 2 is a contour plot of X-ray energy flux enhancement for various values of alpha and beta (given in degrees), wherein the azimuth angle was zero degrees and wherein certain contour lines have been omitted for clarity.
Figure 3:
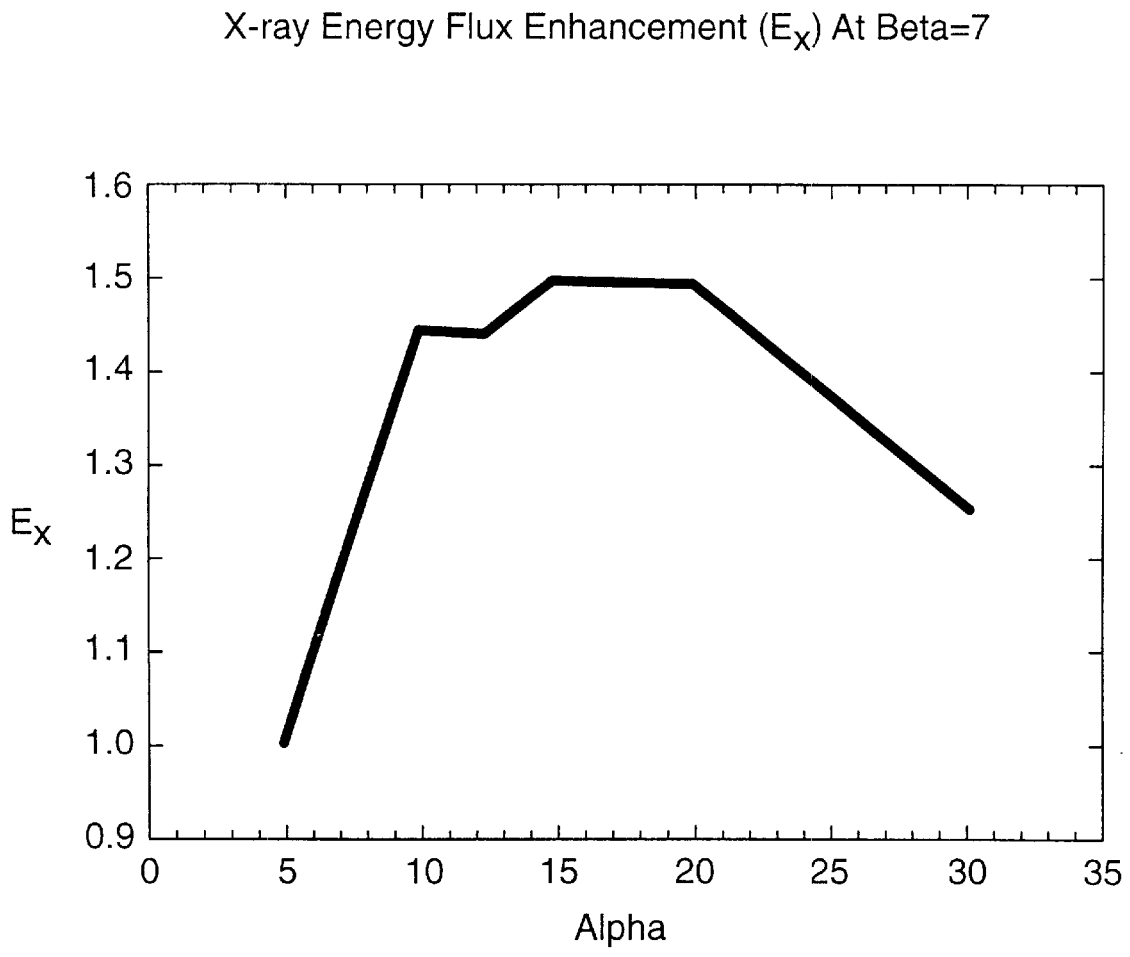
FIG. 3 is s plot of X-ray energy flux enhancement for various values of alpha (given in degrees) wherein beta is seven degrees.

Applicants also performed Monte-Carlo computer-program simulations based on an electron-microscopy computer code optimized for 100–150 kilovolts using the experimental data to benchmark the computer program. The results of the benchmarked Monte-Carlo simulations are presented in FIG. 2 as an x-y contourmap plot of X-ray energy flux enhancement with the y-axis representing alpha (i.e., the first angle 26) and the x-axis representing beta (i.e., the second angle 34). Surprisingly, Applicants found a "sweet spot" where the enhancement is at least 1.5 (i.e. the area on and within the enclosed 1.50 contour line in FIG. 2. It is noted that constructing X-ray tubes with an alpha (i.e., first angle 26) of less than fifteen degrees and/or with a beta (i.e., second angle 34) of less than five degrees presents mechanical-design difficulties, as can be appreciated by those skilled in the art. It also is noted that modifying a prior-art X-ray tube design having an alpha of ninety degrees and a beta of seven degrees to have an alpha of generally twenty degrees while keeping beta at generally seven degrees will result in an X-ray energy flux enhancement of close to 1.50 as seen from FIGS. 2 and 3 while minimizing mechanical-design difficulties. A broader design envelope offering improved X-ray energy-flux enhancement, as seen from FIG. 2, with modest mechanical redesign, requires an alpha (first angle 26) between and including fifteen and thirty degrees and a beta (second angle 34) which is less than alpha and which is between and including five and fifteen degrees. Although off the scale of FIG. 2, Applicants found improvement in X-ray energy flux when alpha was between and including fifteen and sixty degrees and when beta was less than alpha.

The foregoing description of several methods and expressions of an embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An X-ray tube assembly comprising, a) an X-ray tube anode including an X-ray-producing target having a surface;

b) an X-ray tube cathode having an electron-beam axis, wherein the electron-beam axis intersects the surface of the target at a focal point, wherein the electron-beam axis is oriented at a first angle with respect to the surface of the target, and wherein the first angle is generally twenty degrees, and c) an X-ray tube window including a surface having a center point, wherein a line between the focal and center points makes a second angle with respect to the surface of the target, and wherein the second angle is generally seven degrees.

2. The X-ray tube assembly of claim 1, wherein the electron-beam axis and the center point define a plane which is oriented generally perpendicular to the surface of the target.

3. The X-ray tube assembly of claim 1, wherein the X-ray tube cathode generates electrons which strike the target producing X-rays having energies less than generally two hundred kilovolts.

4. An X-ray tube assembly comprising:

a) an X-ray tube anode including an X-ray-producing target having a surface;

b) an X-ray tube cathode having an electron-beam axis, wherein the electron-beam axis intersects the surface of the target at a focal point, wherein the electron-beam axis is oriented at a first angle with respect to the surface of the target, wherein the first angle is generally twenty degrees, and wherein the X-ray tube cathode generates electrons which strike the target producing X-rays having energies less than generally two hundred kilovolts; and c) an X-ray tube window including a surface having a center point, wherein a line between the focal and center points makes a second angle with respect to the surface of the target, wherein the second angle is generally seven degrees, and wherein the electron-beam axis and the center point define a plane which is oriented generally perpendicular To the surface of the target.

5. A method for producing X-rays comprising the following steps:

a) generating a beam of electrons, wherein the beam has an electron-beam axis;

b) orienting the beam of electrons to strike a focal spot on a surface of an X-ray-producing target to produce X-rays such that the electron-beam axis makes a first angle with respect to the surface of the target and such that the first angle is generally twenty degrees; and c) utilizing those X-rays which make a second angle with respect to the surface of the target, and wherein the second angle is generally seven degrees.

6. The method of claim 5, wherein step c) includes utilizing those X-rays which, together with the electron-beam axis, define a plane oriented generally perpendicular to the surface of the target.

7. The method of claim 6, wherein step b) produces X-rays having energies less than generally two hundred kilovolts.

8. A method for producing X-rays comprising the following steps:

a) generating a bean of electrons, wherein the beam has an electron-beam axis;

b) orienting the beam of electrons to strike a focal spot on a surface of an X-ray-producing target to produce X-rays having energies less than generally two hundred kilovolts such that the electron-beam axis makes a first angle with respect to the surface of the target and such that the first angle is generally twenty degrees; and c) utilizing those X-rays which make a second angle with respect to the surface of the target, wherein the second angle is generally seven degrees, and which, together with the electron-beam axis, define a plane oriented generally perpendicular to the surface of the target.

* * * * *